United States Patent [19]

Nohmi et al.

[11] 4,384,695

[45] May 24, 1983

[54] CONTROL METHOD FOR STOPPING TRAIN AT TARGET POINT

[75] Inventors: Makoto Nohmi; Hirokazu Ihara, both of Machida; Masahiro Yasunami, Katsuta, all of Japan

[73] Assignee: Hitachi, Ltd., Tokyo, Japan

[21] Appl. No.: 168,259

[22] Filed: Jul. 10, 1980

[30] Foreign Application Priority Data

Jul. 13, 1979 [JP] Japan ..... 54-88117

[51] Int. Cl.[3] ..... B61L 3/08

[52] U.S. Cl. ..... 246/182 B; 246/187 B; 364/426

[58] Field of Search ..... 246/187 B, 187 R, 182 R, 246/182 A, 182 B, 182 C, 62, 23; 104/300; 364/426, 424; 324/161-163

[56] References Cited

U.S. PATENT DOCUMENTS

| | | | |
|---|---|---|---|
| 3,921,946 | 11/1975 | Norton et al. | 246/182 A |
| 4,066,230 | 1/1978 | Nohmi et al. | 246/182 B |
| 4,142,700 | 3/1979 | Ubel | 246/182 C |

OTHER PUBLICATIONS

*Control Engineering,* Ito, Jan. 1961, pp. 90-93.

*Primary Examiner*—James J. Groody
*Attorney, Agent, or Firm*—Kenyon & Kenyon

[57] ABSTRACT

An improved method for controlling the rate of deceleration and a point of stopping of a vehicle. Upon passing a first position marker, a first deceleration pattern is produced in an arithmetic circuit for stopping the train at a first predetermined point. Second and third deceleration patterns are produced when the vehicle passes a second position marker. In situations where the first deceleration pattern is a proper one, the vehicle velocity is subsequently conformed to the second deceleration pattern which controls the velocity of the vehicle at a lower deceleration rate than the first deceleration pattern, and stops the vehicle at a predetermined target point. However, in situations where an erroneous first deceleration pattern is produced such that the vehicle velocity is maintained at a higher level than either the first or second deceleration patterns, the velocity of the vehicle is subsequently conformed to the third deceleration pattern which is characterized by a high deceleration rate and will stop the vehicle at the target point.

12 Claims, 11 Drawing Figures

TRAIN VELOCITY CONTROL DEVICE
70
LOWER LEVEL SELECTOR
60
Cs
Cx
VELOCITY CONTROL COMMAND CALCULATOR
470
ACTUAL VELOCITY CALCULATOR
460
VT
SELECTOR
452
SEL'
VP3
VP1
VP2
VP1yo
DECISION CIRCUIT
451
VP2yo
VP3yo
yo
VELOCITY PATTERN CALCULATOR
424
427
434
437
V20
β2
V30
β3
ADDER
426
436
422
423
S2
432
433
S3
INITIAL VELOCITY SETTER
421
DECELERATION RATE SETTER
DISTANCE PULSE COUNTER
REGISTER
425
431
435
PS2
ΔS
R

CONTROL METHOD FOR STOPPING TRAIN AT TARGET POINT

BACKGROUND OF THE INVENTION

The present invention relates to a control method for stopping a train precisely at a target point.

A conventional train stopping control method using an automatic train control device (hereinafter referred to as "ATO" device), for stopping a train or similar vehicle may be described as follows:

(1) Position markers in the form of signal transmitters, are situated at preselected locations short of the target point for informing the vehicle of its position;

(2) The vehicle determines its position in response to the signals from the position markers, and generates at least one decreasing velocity pattern (hereinafter referred to as "velocity pattern"); and (3) The velocity of the vehicle is controlled in conformance with the velocity pattern and stops at a target point.

A conventional controlling method for stopping a train which is arriving at a station, at a target point, is disclosed in U.S. Pat. No. 4,066,230, and will be discussed herein with reference to FIG. 1.

In FIG. 1, the ATO device (not shown) on a train destined for a station S, determines that the train has passed a point A by receipt of a signal from a first position marker.

In accordance with the detection signal, the ATO device generates a first velocity pattern $V_{P1}$ which is to decelerate the train at a rate of 2.5 Km/h/sec from an initial velocity of, for example, 75 Km/h.

As the train runs further to arrive at a point B, the actual velocity of the train coincides with the first velocity pattern, so that the ATO device produces a brake command to decelerate the train in accordance with the first velocity pattern $V_{P1}$. As the train which is being decelerated reaches a point C, the ATO device receives a signal from a second position marker and is informed of the arrival at the point C. The ATO device then produces a second velocity pattern $V_{P2}$, in accordance with the detection signal, to decelerate the train at a rate of 1.5 Km/h/sec from an initial velocity of, for example, 15 Km/h. The ATO device is adapted to make a higher level selection, i.e., to select the one of higher level out of two velocity patterns $V_{P1}$ and $V_{P2}$. In consequence, the control is switched from the following control following the first velocity pattern to the following control of the second velocity pattern which is of the higher level. In consequence, the ATO device acts to decelerate the train in accordance with a velocity pattern $V_{P2}$ and, as it reaches a point D in the vicinity of the target point E, it detects the arrival at the point D upon receipt of a signal from a third position marker located at the position D. Upon receipt of this signal, the ATO device issues a brake command to a train speed controller to stop the train at the target point.

Referring now to FIG. 2 showing a train stopping control unit of a conventional ATO device, a receiver 20 receives a signal from a position marker 10 and produces a position signal PS. This position signal PS is applied together with distance pulses ΔS generated by a tacho-generator which is a detector for detecting the running distance of the vehicle to an arithmetic unit 40.

The arithmetic unit 40 has an initial velocity setter 41 and a deceleration rate setter 42 which produce, respectively, an initial velocity setting and a deceleration rate setting in accordance with the position signal PS derived from the receiver 20. The arithmetic unit 40 further has a distance pulse counter 43 which calculates the running distance from the distance pulses ΔS derived from the tacho-generator 30 and the position signal PS. This calculated running distance is applied to a velocity pattern calculator 44.

An actual velocity calculator 46 calculates the actual velocity of the train in response to distance pulses ΔS. The velocity pattern calculator 44 produces a velocity pattern signal in accordance with the calculated distance signal, an initial velocity setting signal and a deceleration rate setting signal which is conducted to a comparator 45 which produces a brake output as a control command C. Control command C is proportional to the difference between the velocity pattern and the actual velocity of the train. The velocity of the train is controlled in accordance with this command C.

In the conventional method for stopping a train, using more than one velocity pattern, the velocity pattern having a higher velocity level is followed. The train can be stopped precisely at the target point in a comfortable manner if the generation of the first velocity pattern is made correctly and adequately. However, if the initial velocity setter 41 fails to provide the initial velocity signal of the first velocity pattern correctly, or if the deceleration rate setter 42 fails to provide the deceleration rate setting signal of the first velocity pattern correctly, the first velocity pattern $V_{P1A1}$ shown by a one-dot-and-dash line in FIG. 3 of a velocity pattern $V_{P1A2}$ as shown by two-dots-and-dash line in FIG. 3 are formed. In such a case, the second velocity pattern $V_{P2}$ does not take the higher level in relation to the first velocity pattern $V_{P1A1}$ or $V_{P2A2}$. Therefore, the stopping control is made to regulate the train velocity following up the first velocity pattern $V_{P1A1}$ or $V_{P1A2}$, rather than the second velocity pattern, so that the train runs too far over the target point as will be understood from FIG. 3.

A solution to the above-described problem of the prior art is disclosed in Japanese Patent Laid-open No. 59409/1977, in which the ATO device receives a position signal from a second or third position marker after the train has run into a predetermined stopping control region and, if the train velocity is higher than a predetermined velocity, actuates an emergency brake or maximum normal brake or, alternatively, actuates the brake in several steps in accordance with the velocity difference, thereby to prevent the train from over-running.

This control method can stop the train at a point near the target point even in the case of erroneous operation of the initial velocity setter or the deceleration rate setter, because the brake is used to forcibly stop the train. However, this method still cannot stop the train precisely at the target point, because the stopping distance is varied by weather or other conditions.

SUMMARY OF THE INVENTION

It is, therefore, an object of the invention to provide a train stopping control method capable of precisely and comfortably stopping the train at the target point when the generation of the first velocity pattern is made correctly and, when the generation of the first velocity pattern is made incorrectly, stopping the train precisely at the target point, thereby to overcome the above-described problem of the prior art.

To this end, according to the invention, a third velocity pattern of larger deceleration rate than the first velocity pattern is formed, and the first and the third velocity patterns are used in lower level selection. The train velocity is controlled in accordance with the selected one of the first and the third patterns. By so doing, it is possible to stop the train precisely at the target point, even if the generation of the correct first velocity pattern is failed.

DESCRIPTION OF THE PREFERRED EMBODIMENTS

Figure 4:
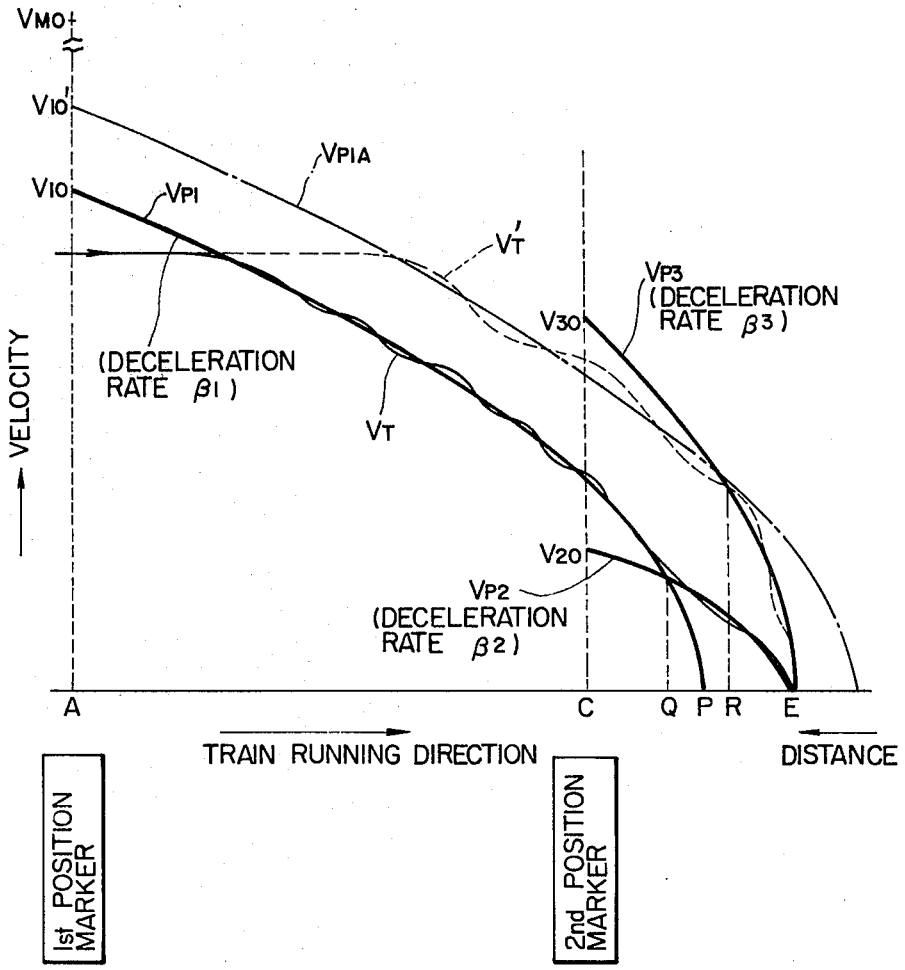
FIG. 4 is a distance-velocity pattern diagram for explaining the principal of the present invention.

Hereinafter, the principle of the invention will be described with reference to FIG. 4. A first velocity pattern which is used also in the conventional control method is designated at $V_{P1}$ which is produced in accordance with a signal generated when the train has passed a first point A. When the setting of the initial velocity of the first velocity pattern $V_{P1}$ is made erroneously, a first pattern $V_{P1A1}$ as shown by one-dot-and-dash line is formed. A symbol $V_{P2}$ designates a second velocity pattern having a smaller rate of deceleration than the first velocity pattern $V_{P1}$. This second velocity pattern $V_{P2}$ is generated in accordance with a signal which is produced when the train has passed a second point C. A symbol $V_{P3}$ represents a third velocity pattern which is peculiar to the method of the invention and having a deceleration rate greater than that of the first velocity pattern $V_{P1}$. In FIG. 4, the third pattern $V_{P3}$ is shown to be generated in accordance with a signal which is generated when the train passes the second point C. This, however, is not exclusive and the third velocity pattern $V_{P3}$ may be formed in accordance with a signal from a third position marker which is positioned between the first and second points A and C or between the second point C and the target point E.

The following preferential or selection logic is used to determine to which one of the velocity patterns $V_{P1}$, $V_{P2}$ and $V_{P3}$ the train velocity control should follow.

(1) The selection between the first and second velocity patterns is made in accordance with higher level selection as in the case of conventional control. In FIG. 4, the velocity patterns $V_{P1}$ and $V_{P2}$ intersect each other at a point Q. Thus, the first velocity pattern $V_{P1}$ takes the higher level in the region between the first point A and the point Q, while, in the region between the point Q and the target point, the second velocity pattern $V_{P2}$ takes the higher level, in relation to the other pattern.

(2) The selection between the third pattern and the first or second pattern is made in accordance with lower level selection. When all of the first, second and third velocity patterns are correct, these patterns are shown by $V_{P1}$,$V_{P2}$ and $V_{P3}$, respectively, so that the velocity patterns $V_{P1}$,$V_{P2}$ always take the lower level in relation to the velocity pattern $V_{P3}$. In the event that the initial velocity in the first velocity pattern is made erroneously to form a first velocity pattern $V_{P1A}$, the velocity patterns $V_{P1A}$ and $V_{P3}$ intersect each other at a point R. In such a case, the velocity pattern $V_{P1A}$ is the lower level selection pattern in the region between the first point A and the point R, whereas, in the region between the point R and the target point E, the velocity pattern $V_{P3}$ is the lower level selection pattern. The train velocity is controlled by tracking the lower velocity pattern.

The actual train velocity control will be discussed below with specific reference to FIG. 4. It is assumed that the train passes the first point A at a velocity $V_{10}$ and the first position signal is generated.

(A) In the case where the correct first velocity pattern $V_{P1}$ is formed

In this case, the tracking control is made to decelerate the train velocity by following the first velocity pattern, $V_{P1}$. Then, as the train passes the second point, the ATO device produces the second and the third velocity patterns, $V_{P2}$ and $V_{P3}$, upon receipt of the second position signal. The selection is made of the one of velocity patterns $V_{P1}$ and $V_{P2}$ which is at a lower level with respect to the velocity pattern $V_{P3}$. Also, in the region between the second point and the point Q, the velocity pattern $V_{P1}$ is the higher level selection pattern in relation to the velocity pattern $V_{P2}$. Further, the velocity pattern $V_{P2}$ is the higher level selection pattern in relation to the velocity pattern $V_{P1}$. Therefore, the train velocity is controlled and deceleration is made accordance with the velocity pattern $V_{P1}$, until the train comes near the point Q. Then, the control pattern is switched from the pattern $V_{P1}$ to the pattern $V_{P2}$ in the area near the point Q to further decelerate the train, until the latter is stopped. In this case, the actual train velocity follows a distance-velocity pattern $V_T$. By the described control, it is possible to stop the train precisely and comfortably at the target point.

(B) In the case where the initial velocity in the first velocity pattern is set erroneously In this case, the velocity pattern $V_{P1A}$ is generated, and the train is decelerated in accordance with this pattern. The third and second velocity patterns $V_{P2}$ and $V_{P3}$ are generated in accordance with the second position signal. Then, the aforementioned selection logic is adopted. Namely, the velocity pattern $V_{P1A}$ is always the higher level selection pattern in relation to the velocity pattern $V_{P2}$. In the region between the second point C and the point R, the velocity pattern $V_{P1A}$ is the lower level selection pattern in relation to the velocity pattern $V_{P3}$. Further, in the region between the point R and the target point E, the velocity pattern $V_{P3}$ is the selected lower level pattern in relation to the velocity pattern $V_{P1A}$. Therefore, the train is decelerated in accordance with the velocity pattern $V_{P1A}$ until the train reaches a point near the point R, but the velocity pattern is changed from $V_{P1A}$ to $V_{P3}$ at the point near the point R and the train is decelerated and stopped in accordance with this velocity pattern $V_{P3}$. In this case, the train velocity actually follows a distance-velocity pattern $V_T'$ as shown by broken line in this Figure. Since the train velocity finally follows the velocity pattern $V_{P3}$, it is possible to stop the train precisely at the target point.

In the foregoing explanation, the velocity patterns $V_{P2}$ and $V_{P3}$ are generated upon receipt of the second position signal. However, this arrangement is not exclusive, and it is possible to obtain the third velocity pattern in accordance with a third position signal issued from a third position marker located at a third point closer to the target point than the first point, while obtaining the second velocity pattern in accordance with the second position signal.

Hereinafter, preferred embodiments of the invention will be fully described with reference to the drawings. In this specification, four preferred embodiments are shown in FIGS. 5 to 8, respectively. The point of difference of these embodiments resides in the timing at which the tracking control is switched from one velocity pattern to the other.

Figure 5:
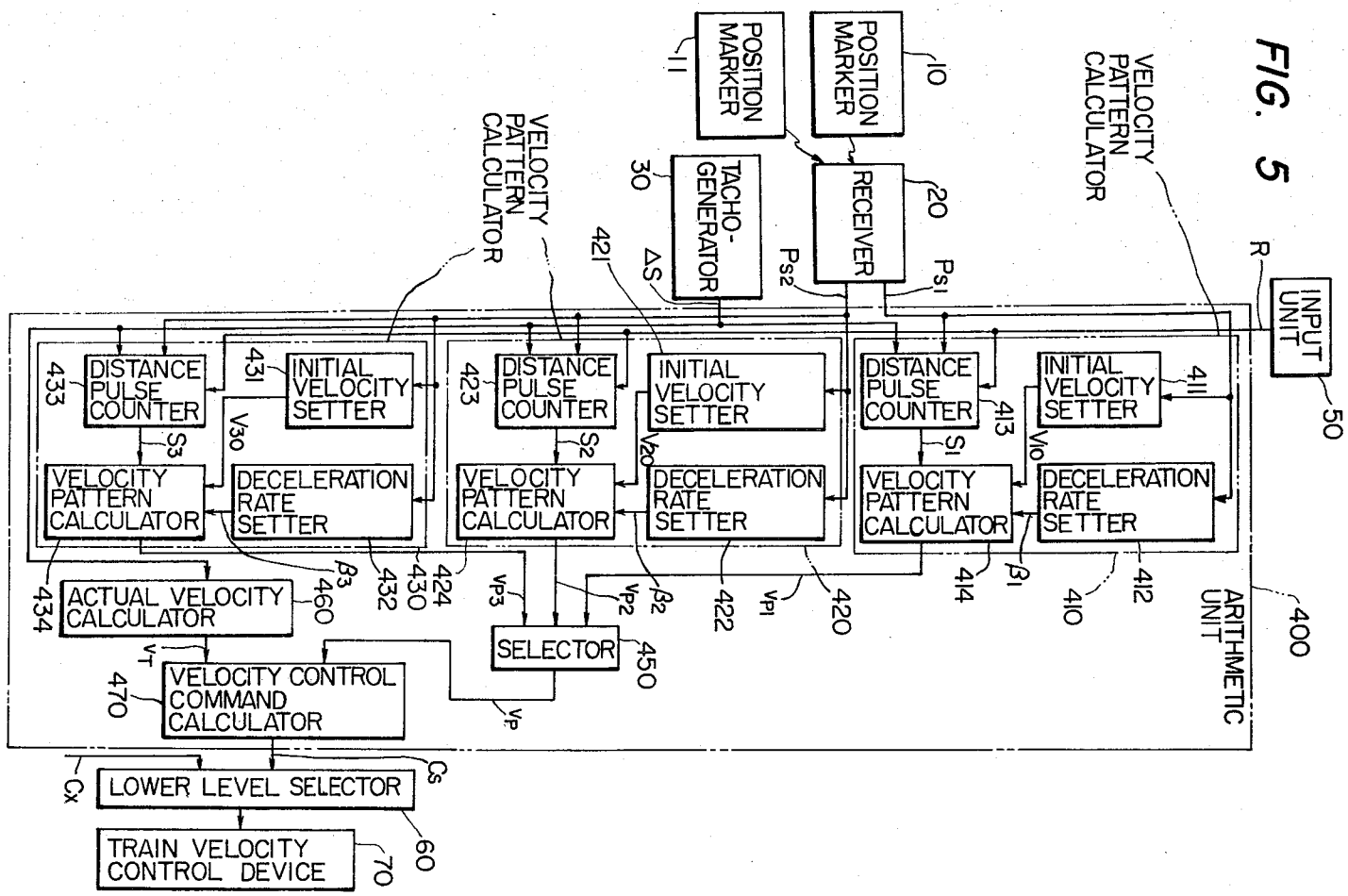
FIG. 5 is a block diagram of an ATO device in accordance with a first embodiment of the invention in which the train stopping control is modified depending on the higher or lower level of the velocity pattern.

More specifically, in the first embodiment shown in FIG. 5, the switching is made at a moment at which the second or third velocity pattern comes to take the higher or lower level.

Figure 6:
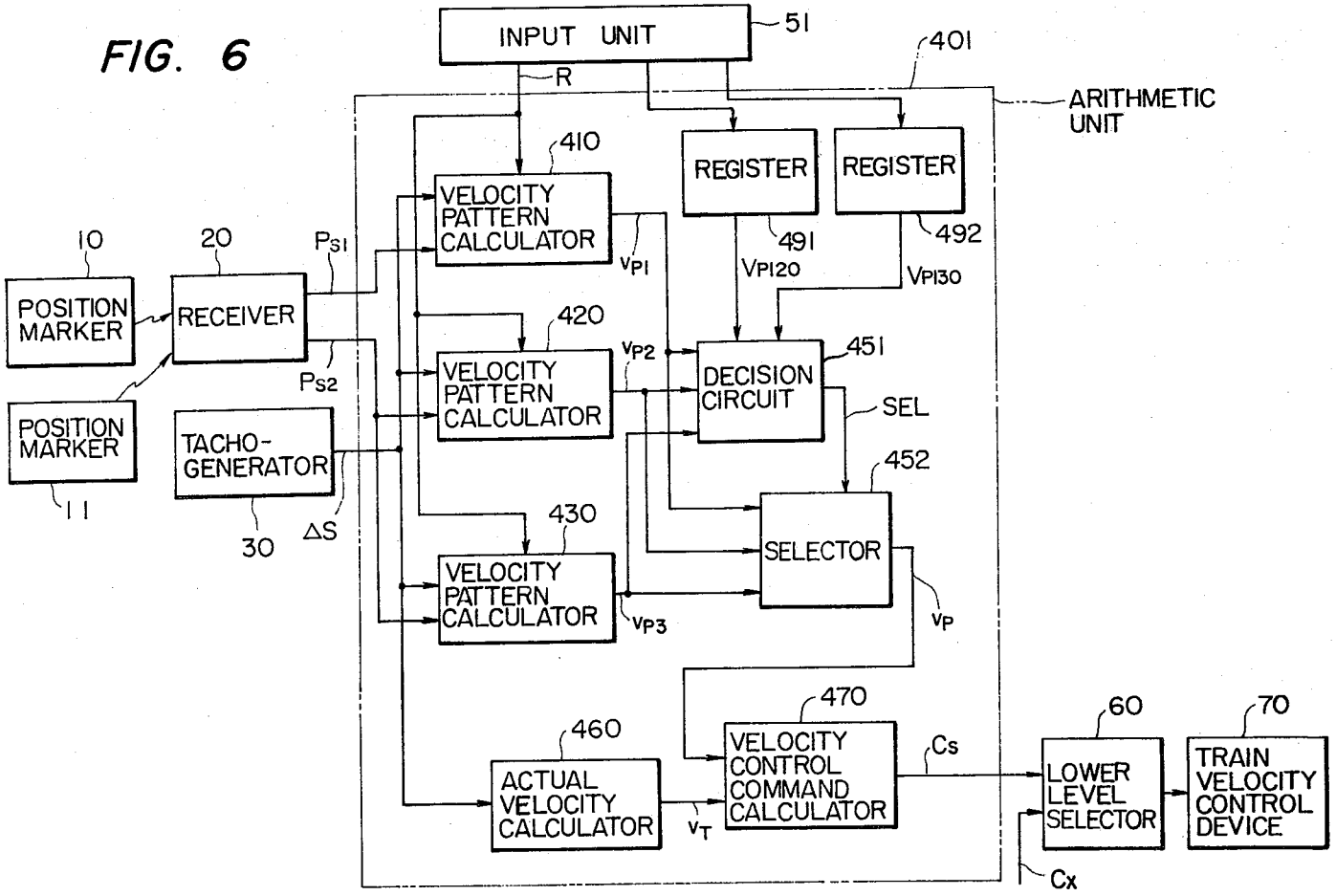
FIG. 6 is a block diagram of an ATO device in accordance with a second embodiment of the invention in which the train stopping control is modified when the velocity difference between two velocity patterns has reached a predetermined value.

In the second embodiment shown in FIG. 6, the switching is made at a moment at which the difference between the second or third velocity pattern and the first velocity pattern has grown to a predetermined value.

In the third embodiment of the invention shown in FIG. 7, the switching is made at a point which is a predetermined distance short of a point at which the second or third velocity pattern comes to take the higher or lower level.

Figure 8:
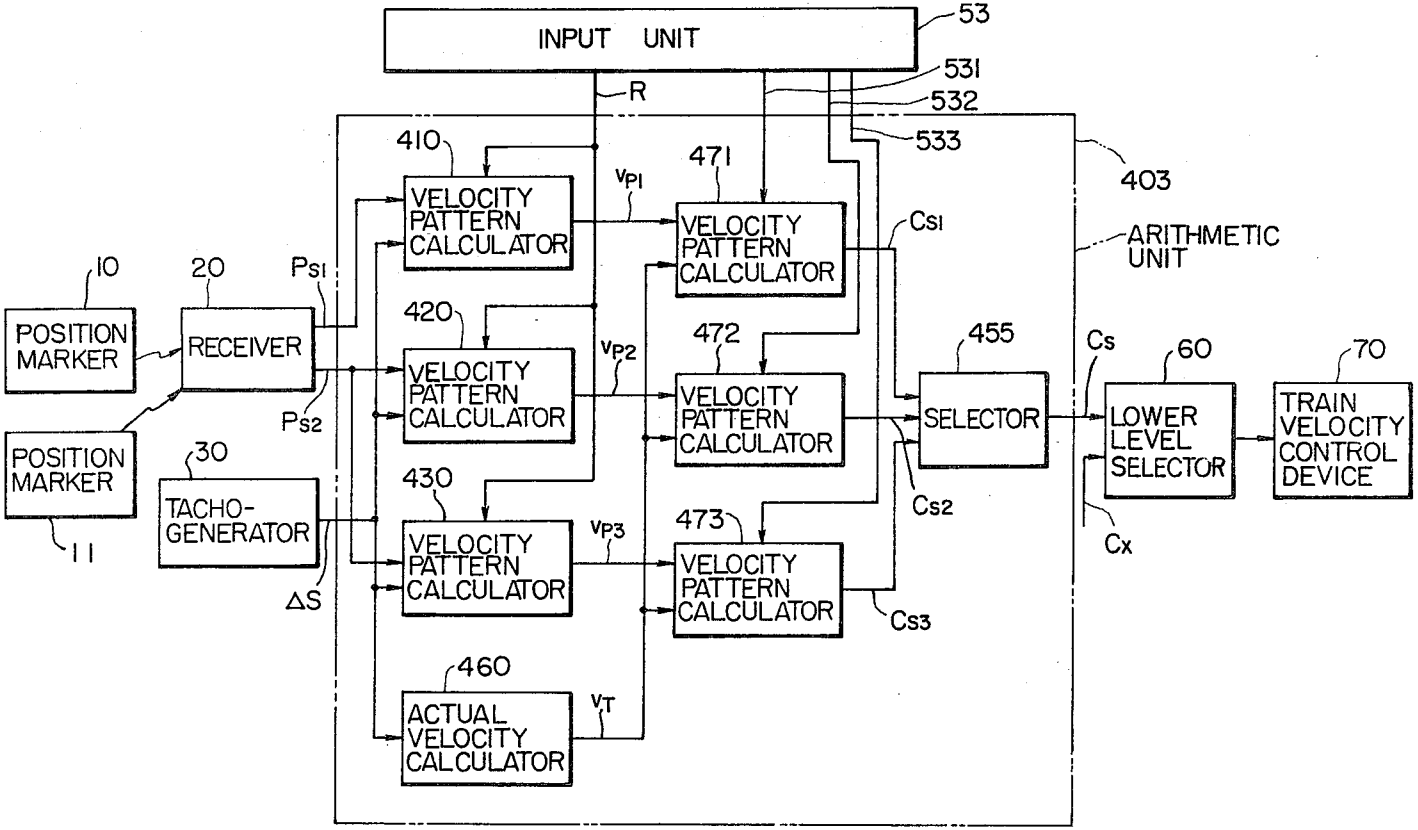
FIG. 8 is a block diagram of an ATO device in accordance with a fourth embodiment of the invention in which the pattern tracking control is modified at a point at which the commands for tracking the patterns come to take the same level.

In the fourth embodiment of the invention shown in FIG. 8, the switching is made at a moment at which the control command for tracking the first velocity pattern comes to take the same level as the control command for tracking the second or third velocity pattern.

(1) Embodiment 1

FIG. 5 shows the first embodiment of the invention in which the tracking control is switched to the second or third velocity pattern at a moment at which the second or the third velocity pattern come to take the higher or lower level.

In this Figure, reference numerals 10,11 denote position markers, while a numeral 20 denotes a receiver. A tacho-generator is designated at a reference numeral 30, while an arithmetic unit is denoted by a numeral 400. A reference numeral 50 designates an input device, 60 denotes a lower level selection circuit and 70 designates a train velocity control device. The arithmetic unit 400 is constituted by a first, second and third velocity pattern calculators 410,420 and 430, selector 450, actual velocity calculator 460 and a velocity control command calculator 470. The velocity pattern calculator 410 includes an initial velocity setter 411 and a deceleration rate setter 412, a distance pulse counter 413 and a velocity pattern calculator circuit 414. Similarly, the velocity pattern calculator 420 includes an initial velocity setter 421, deceleration rate setter 422, distance pulse counter 423 and a velocity pattern calculator circuit 424. Also, the valocity pattern calculator 430 includes setters 431,432, distance pulse counter 433 and a velocity pattern calculator circuit 434.

When the train starts to run, the input device 50 issues a reset signal R. The distance pulse counters 413,423 and 433 of the first, second and third velocity pattern calculators are cleared by this reset signal R.

Values $V_{10}$, $V_{20}$,$V_{30}$,$\beta_1$,$\beta_2$,$\beta_3$ and $V_{Mo}$ are beforehand determined as follows in relation to FIG. 4.

Namely, the initial velocity of the first velocity pattern $V_{P1}$ is determined at a level which is a predetermined value above the maximum velocity at which the train passes the first point.

Arithmetic operation is made in accordance with the following equation (1), representing the distance between a point X and the first point by $y_{1x}$.

$$\beta_1 = \frac{V_{10}^2}{2y_{1x}} \tag{1}$$

The deceleration rate $\beta_1$ is determined in accordance with the above equation (1).

Then, the deceleration rates $\beta_2$ and $\beta_3$ are determined to be smaller and greater than $\beta_1$, respectively. Representing the distance between the second point and the target point by $y_{20}$, arithmetic operations are made in accordance with the following equations (2) and (3).

$$V_{20} = \sqrt{2\beta_2 y_{20}} \tag{2}$$

$$V_{30} = \sqrt{2\beta_3 y_{20}} \tag{3}$$

The initial velocities $V_{20}$ and $V_{30}$ of the second and third velocity patterns are determined in accordance with the above equations (2) and (3). On the other hand, a dummy velocity $V_{MO}$ is determined at a level considerably greater than that of the velocity $V_{10}$.

When the train is running at a point short of the first point, the distance pulse counters 413,423 and 433 make no counting operation, and the outputs $S_1$, $S_2$ and $S_3$ from these circuits are held at zero level. The velocity pattern calculator circuit 414 produces, when the signal $S_1$ is at zero level, a dummy velocity $V_{MO}$ as the velocity $V_{P1}$. Similarly, when the signals $S_2$ and $S_3$ take the zero level, the velocity pattern calculator circuits 424,434 produce zero and $V_{MO}$ as the velocities $V_{P2}$ and $V_{P3}$. Since the selection between the velocity patterns $V_{P1}$ and $V_{P2}$ is made in accordance with higher level selection, and since the selection between the velocity pattern $V_{P1}$ or $V_{P2}$ and $V_{P3}$ is made by lower level selection, the selector 450 makes an arithmetic operation in accordance with the following equation (4).

$$V_P = \min\{\max(V_{P1}, V_{P2}), V_{P3}\} \tag{4}$$

An arithmetic operation following the equation (5) shown below may be made in place of the equation (4).

$$V_P = \max\{\min(V_{P1}, V_{P3}), V_{P2}\} \quad (5)$$

In these equations, max (A,B) means a logic to select the higher one of A and B, while min (A,B) represents a logic to select the lower one of A and B. Namely, when the value of A is higher than that of B, the max (A,B) and min (A,B) are A and B, respectively.

Substituting $V_{P1}=V_{MO}$, $V_{P2}=0$ and $V_{P3}=V_{M0}$ to the equation (4), derived is $V_P=V_{M0}$, so that the selector 450 produces $V_{MO}$ as its output. The distance pulses $\Delta S$ as the output from the tachogenerator 30 are delivered to the actual velocity calculator 460 and is transformed into the actual velocity $V_T$ of the train. Then, the velocity contrrol command circuit 470 makes an operation in accordance with the following equation (6), from the pattern velocity $V_P$ and the actual train velocity $V_T$.

$$Cs=(V_P-V_T)G-B_0 \quad (6)$$

As a result, the control command Cs is obtained. In the equation (6) above, the symbols G and $B_0$ represent the control gain constant and the brake bias, respectively.

If the $V_P=V_{M0}$ is substituted, the control command $C_S$ takes a large positive value to power the train, because the dummy velocity $V_{MO}$ is much greater than the actual velocity $V_T$.

A symbol Cx represents a control command for effecting a tracking control following up an aimed velocity which is determined by the ATC and the control instructions given from the station. In the region short of the first point, the control command usually takes a value smaller than the control command Cs. For instance, when the train is running at a velocity substantially following up the aimed velocity, the control command Cx takes substantially zero level and, hence, is considerably smaller than Cs.

The lower level selector 60 operates to select one out of the commands Cx and Cs in accordance with the lower level selection logic. Therefore, when the train is at a point short of the first point, the train velocity control device 70 receives the command Cx which is smaller than the command Cs. In consequence, the train velocity is controlled tracking the aimed velocity before the train passes the first point.

As the train runs to the first point, the receiver 20 receives a signal from a first position marker 10 situated at the first point. The receiver 20 then delivers a position signal PS1 to the first velocity pattern calculator 410 so that the initial velocity setter 411 and the deceleration setter 412 in the calculator 410 set the initial velocity $V_{10}$ and deceleration rate $\beta_1$ in accordance with the position signal PS1. More practically, the receiver 20 makes a frequency discrimination for the signal from the position marker 10, and the initial velocity setter 411 and the deceleration rate setter 412 set the initial velocity and the deceleration rate in accordance with the signal SP1 corresponding to the discriminated frequency. Also, the distance pulse counter 413 which has been cleared commences the counting of the distance pulses $\Delta S$ delivered from the tacho-generator 10, upon receipt of the position signal SP1, and calculates the running distance $S_1$ between the first point and the instant position of the train. The velocity pattern calculator circuit 414 calculates the pattern velocity $V_{P1}$ of successive moments from the initial velocity $V_{10}$, deceleration rate $\beta_1$ and the running distance $S_1$, in accordance with the following equation (7).

$$V_{P1} = \sqrt{V_{10}^2 - 2\beta_1 S_1} \quad (7)$$

The pattern velocity, therefore, is changed from $V_{MO}$ to $V_{P1}$ which is determined in accordance with the equation (7) above. Meanwhile, the velocities $V_{P2}$ and $V_{P3}$ are maintained at 0 and $V_{MO}$, eespectively. Therefore, the pattern velocity $V_P$ is determined from the aforementioned equation (4), in accordance with the following equation (8).

$$V_P = \min\{\max(\sqrt{V_{10}^2 - 2\beta_1 S_1}, 0), V_{MO}\} \quad (8)$$

By submitting the equation (6) to the equation (8), the output Cs from the train velocity command calculator 470 is derived from the following equation (9).

$$Cs = (\sqrt{V_{10}^2 - 2\beta_1 S_1} - V_T)G - Bo \quad (9)$$

Therefore, as the train velocity approaches the velocity pattern $V_{P1}$, the value of the control command Cs is gradually lowered from a positive value and comes to take a negative value. Namely, the command Cs is changed from a large powering instruction to small powering instruction and then to braking instruction of gradually increasing level. At an instant at which the value of the control command Cs has become smaller than that of the control command $C_X$, the train velocity is controlled following up the velocity pattern $V_{P1}$.

As the train is decelerated in accordance with the normal velocity pattern $V_{P1}$ and reaches at a second point, the receiver 20 receives a second position signal PS2 issued from a second position marker 11 situated at the second point, and delivers the second position signal PS2 to the second and third velocity pattern calculators 420 and 430 which operate in the same manner as the first velocity pattern calculator 410.

Namely, the initial velocity setters 421,431 and the deceleration rate setters 422,432 set the initial velocities $V_{20}$,$V_{30}$ and deceleration rates $\beta_2$, $\beta_3$ in accordance with the position signal PS2. Also, the distance pulse counters 423,433, which have been cleared, start to count the distance pulses $\Delta S$ to calculate the distances $S_2$ and $S_3$. The signals $S_2$ and $S_3$ represent the distance between the second point which has just passed by the train and the instant position of the train, and are equal to each other in the normal state.

The velocity pattern calculator circuit 424 calculates the velocity $v_{P2}$ of successive moments in the second velocity pattern $V_{P2}$, from the velocity $V_{20}$, deceleration rate $\beta_2$ and the distance $S_2$, in accordance with the following equation (10)

$$v_{P2} = \sqrt{V_{20}^2 - 2\beta_2 S_2} \quad (10)$$

Similarly, the velocity pattern calculator makes an arithmetic operation in accordance with the following equation (11).

$$v_{P3} = \sqrt{V_{30}^2 - 2\beta_2 S_2} \quad (11)$$

As will be understood from FIG. 4, the relationship $V_{P1}, V_{P2}$ $V_{P3}$ is always established when the velocity patterns $V_{P1}, V_{P2}$ and $V_{P3}$ are right. Therefore, the selector 450 provides the output $v_P$ following the equation (4), as shown by the equation (12) below.

$$V_P = min\ \{max(V_{P1}, v_{P2}), V_{p3}\} \quad (12)$$
$$= \max(v_{P1}, v_{P2})$$
$$= \max(\sqrt{V_{10}^2 - 2\beta_1 S_1}, \sqrt{V_{20}^2 - 2\beta_2 S_2})$$

Then, the output of the selector 450 is switched from the velocity pattern $V_{P1}$ to $V_{P2}$ at a moment at which the second velocity pattern $V_{p2}$ has become greater than the first velocity pattern $V_{P1}$, i.e. at the point Q. Therefore, the output Cs from the train velocity controc command calculator 470 takes a value given by the following equations (13) and (14), respectively, before and after the switching.

$$Cs = (\sqrt{V_{10}^2 - 2\beta_1 S_1} - v_T)G - Bo \quad (13)$$

$$Cs = (\sqrt{V_{20}^2 - 2\beta_2 S_2} - v_T)G - Bo \quad (14)$$

The lower level selector 60 produces the output Cs before and after the switching, because the Cs level is lower than the Cx level before and after the switching of pattern.

Therefore, the train velocity is controlled following up the velocity pattern $V_{P1}$ till the moment at which the velocity pattern $V_{P1}$ comes to take the lower level than the velocity pattern $V_{P2}$ and, thereafter, the train is decelerated and stopped in accordance with the velocity pattern $V_{P2}$.

It is assumed here that the initial velocity setter has erroneously set $V_{10A}$ for the initial velocity $V_{10}$. In such a case, the output from the velocity pattern calculator circuit 414 is given by the following equation (15), replacing the $V_{10}$ of the equation (7) with $V_{10A}$.

$$v_{p1} = \sqrt{(V_{10A})^2 - 2\beta_1 S_1} \quad (15)$$

Also, substituting the equation (15), $v_{P2}=0$ and $v_{P3}=V_{MO}$ to the equation (4), the output $v_p$ from the selector 450 is given by the following equation (16).

$$v_p = \sqrt{(V_{10A})^2 - 2\beta_1 S_1} \quad (16)$$

Further, substituting the equation (18) to the equation (6), the output Cs from the velocity control command calculator 470 is given by the following equation (17).

$$Cs = (\sqrt{(V_{10A})^2 - 2\beta_1 S_1} - v_T)G - Bo \quad (17)$$

In this case, therefore, the velocity control command Cs is gradually reduced from a positive level to negative level, as the velocity pattern appraoches the wrong pattern $V_{P1A}$ after the train has passed the first point. Namely, the control command Cs is changed from a large powering instruction to smaller powering instruction and then to small brake instriction and finally to a large brake instruction. At an instant at which the control command Cs has becomes smaller than the control command Cx, the lower level selector 60 produces Cs as its output, so that the train velocity is thereafter controlled tracking the velocity pattern $V_{P1A}$.

As the train is decelerated in accordance with the velocity pattern $V_{P1A}$ and reaches the second point, the velocity pa-tern calculator circuits 424,434 product outputs $v_{P2}, v_{P3}$ in accordance with equations (10),(11), as stated before.

As will be understood also from FIG. 4, the wrong velocity pattern $V_{P1A}$ always takes high level in relation to the second velocity pattern $V_{P2}$, so that the relationship expressed $V_{P2} < V_{P1}$ is always maintained.

Therefore, the output $v_P$ from the selector 450 is derived from the equation (18) below, following the aforementioned equation (4).

$$v_p = \min\ \{\max(v_{P1}, v_{P2}), v_{p3}\} \quad (18)$$
$$= \min(v_{P1}, v_{p3})$$
$$= \min(\sqrt{(V_{10A})^2 - 2\beta_1 S_1}, \sqrt{V_{30}^2 - 2\beta_3 S_3})$$

Therefore, the output of the selector 450 is switched from the velocity pattern $V_{P1A}$ to the velocity pattern $V_{P3}$ at a moment at which the third velocity pattern $V_{P3}$ has become smaller than the first velocity pattern $V_{P1A}$, i.e. at the point R. Therefore, the velocity control command calculator 470 produces output Cs which is expressed by the following equations (19) and (20) before and after the switching.

$$Cs = (\sqrt{(V_{10A})^2 - 2\ \ {}_1S_1} - v_T)G - Bo \quad (19)$$

$$Cs = (\sqrt{V_{30}^2 - 2\ \ {}_3S_3} - v_T)G - Bo \quad (20)$$

Since the control command Cs is smaller than Cx even after the passing of the second point, the lower level selector 60 produces an output Cs. Therefore, till the moment at which the velocity pattern $V_{P3}$ comes to be smaller than $V_{P1A}$, the train velocity is controlled in accordance with the velocity pattern $V_{P1A}$, and, thereafter, the train velocity follows the velocity pattern $V_{P3}$.

As has been described, according to the first embodiment of the invention, the train velocity is controlled in accordance with the second velocity pattern so that the train can be stopped preciesly and comfortably at the target point, if the first velocity pattern is correct. In the case where a wrong first velocity pattern is produced, the train velocity is controlled in accordance with the third velocity pattern, so that the train can be stopped preciselt at the target point.

(2) Embodiment 2

FIG. 6 shows a second embodiment of the invention in which the control is switched to the second or third velocity pattern, at a moment at which a predetermined difference is formed between the first velocity pattern and the second or third velocity pattern. This embodiment offers a higher comfortableness at the time of switching of the control mode, as compared with the first embodiment in which the switching is made when two patterns have matched each other.

The second embodiment of the invention, which will be explained hereinunder with specific reference to FIG. 6 defffers from the first embodiment explained in connection with FIG. 5 in that a combination of registers 491,492, decision circuit 451 and a selection circuit 452 is used in place of the selector 450 of the arithmetic unit 400 of the first embodiment, and that the registers 491,492 are adapted to receive bias velocities $v_{P120}$,$v_{P130}$ from the input device 51 to permit the following control to be conducted.

First of all, the relationship between the comfortableness and the difference of level between the first and second velocity patterns $V_{P1}$,$V_{P2}$ at a moment of switching of the pattern is through experiments or the like. This value is expressed by $v_{P120}$. Similarly, the relationship between the comfortableness and the difference of level between the velocity patterns $V_{P1}$ and $V_{P3}$ is determined previously. This value is represented by $v_{P130}$. These values $v_{p120}$ and $v_{p130}$ are beforehand set in the registers 491,492 by means of the input device 51. The velocity pattern calculators 410,420 and 430 perform the operation same as that explained before in connection with FIG. 5, and produces $v_{p1}$,$v_{p2}$ and $v_{p3}$.

The decision circuit 451 performs a calculation in accordance with the following equation (21).

$$V_{PSEL}=\min\{\max(v_{P1},v_{P2}+v_{p120}),\ v_{P3}-v_{p130}\} \quad (21)$$

The decision circuit 451 then decides whether the conditions given by the following equations (22), (23) and (24) are satisfied.

$$V_{PSEL}=v_{P1} \quad (22)$$

$$V_{PSEL}=v_{P2}+v_{P120} \quad (23)$$

$$V_{PSEL}=v_{P3}-v_{P130} \quad (24)$$

The decision circuit 451 then delivers to the selection circuit 452 a signal SEL which represents that the velocity $v_{P1}$, $v_{P2}$ or $v_{P3}$ should be selected when the equation (22), (23) or (24) is satisfied.

The selection circuit 452 then selects one out out of three velocities $v_{P1}$, $v_{P2}$ and $v_{P3}$ as the velocity $v_P$ which is then delivered to the velocity control command calculator 470 to be processed in the same manner as the first embodiment explained before in connection with FIG. 5, so as to be used in the control of the train velocity. For instance, $v_{P120}$ and $v_{P130}$ are selected to be 0.5 Km/h/sec and 1 Km/h/sec, respectively.

By so doing, it is possible to switch the control from the first velocity pattern to the second or third velocity pattern at a moment at which the difference between the first and the second or third velocity patterns has reached a predetermined value.

(3) Third embodiment

Figure 7A:
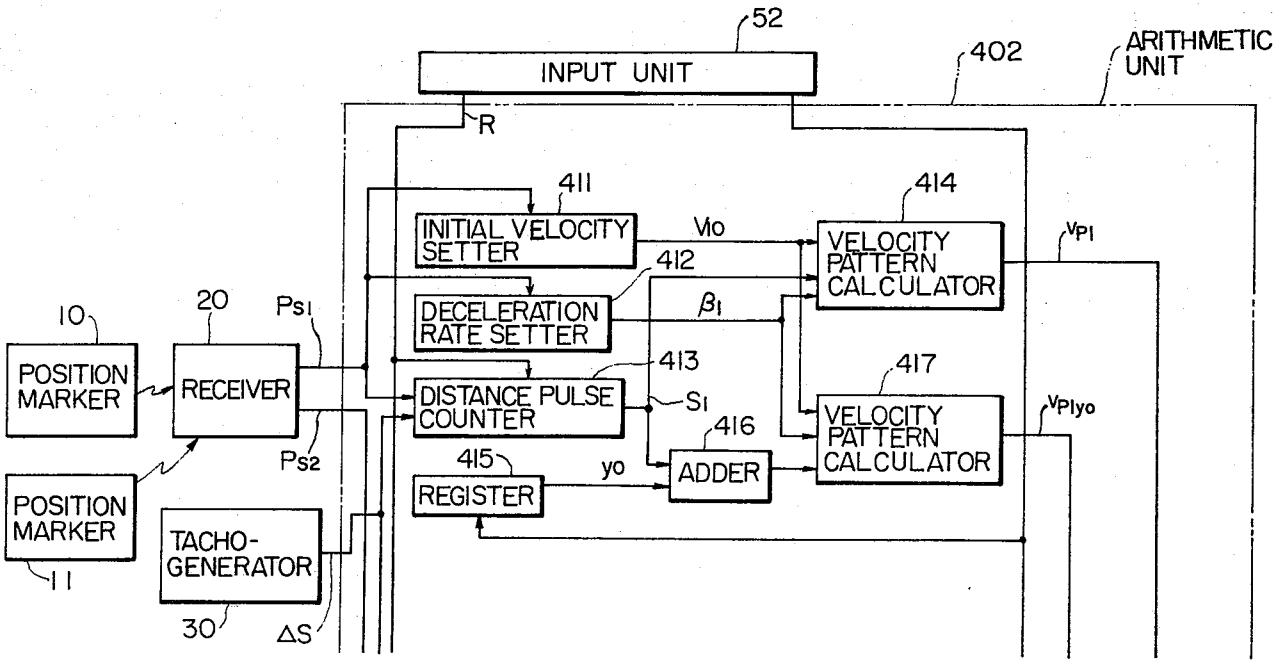
FIGS. 7A and 7B are block diagrams of portions of an ATO device in accordance with a third embodiment of the invention in which the pattern tracking control is modified at a point short of the target point where the velocity pattern comes to take the higher or lower level.
Figures 7A, 7B, 7C:
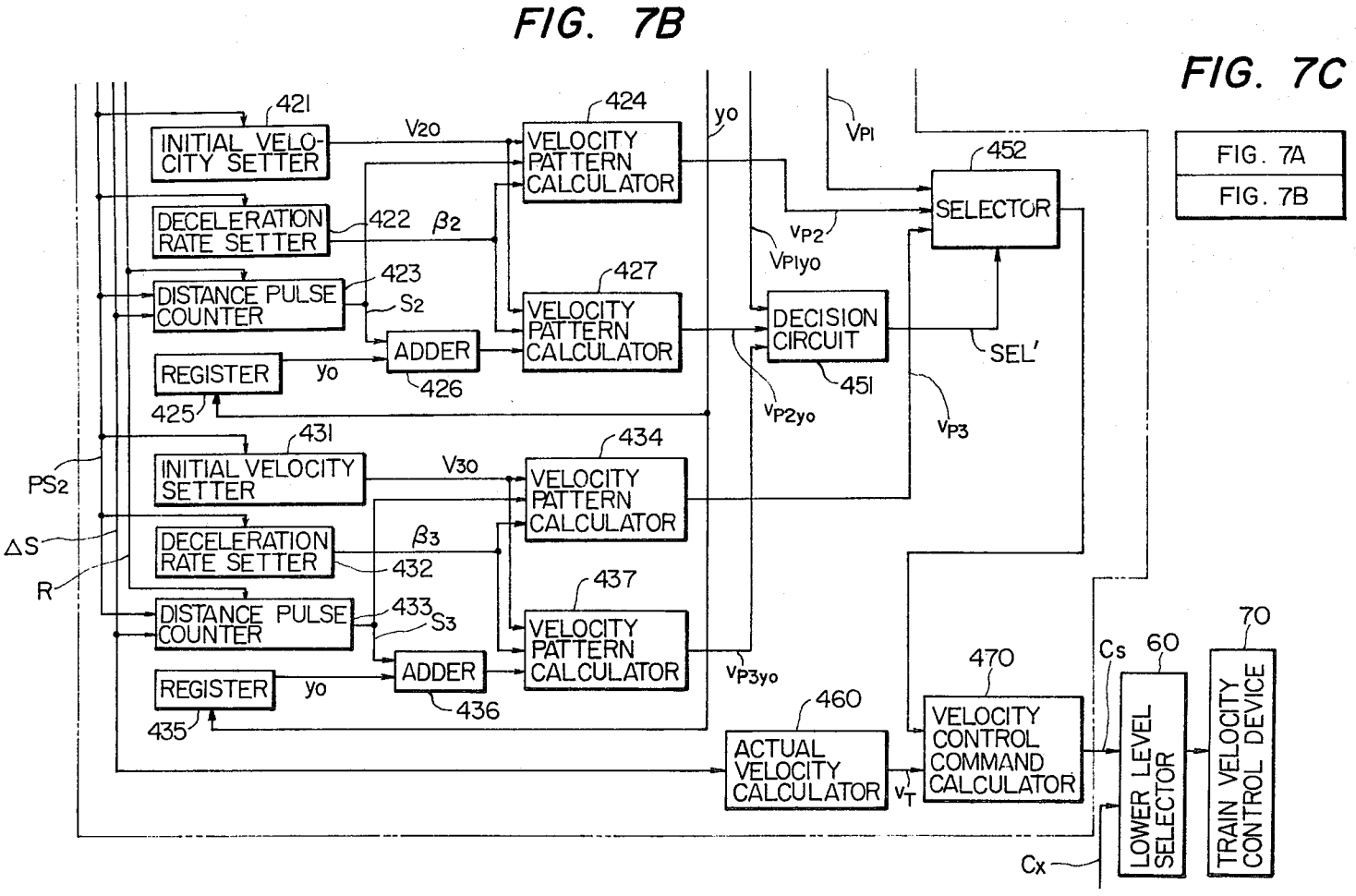
FIG. 7C shows the arrangement of FIGS. 7A and 7B.

FIGS. 7A, 7B and 7C in combination show a third embodiment of the invention, in which the comfortableness is improved by adopting such a control that the switching from the first velocity pattern to the second or third velocity pattern is made at a point $y_o$ short of the point at which the second or third velocity pattern comes to take the higher or lower level than the first velocity pattern. The distance $y_o$ is experimentally obtained from the stand point of improvement of the comfortableness.

The distance value $y_o$ is beforehand set in the registers 415,425 and 435 by means of the input device 52. Then, as in the case of the first embodiment explained in connection with FIG. 5, velocities $v_{P1}$, $v_{P2}$ and $v_{P3}$ are experimentally determined by the combination of circuits 411,412,413,414, combination of the circuits 421,422,423,424 and the combination of the circuits 431,432,433,434, respectively, and are delivered to a selector 452 which is identical to that 452 in the second embodiment explained in connection with the second embodiment. The circuits 417,427, 437 perform the same function as the circuits 414,424, 434. Reference numerals 416,426,436 denote adders.

The adder 416 addes a signal $S_1$ to the distance value $y_o$ and delivers the output signal $(S_1+y_o)$ to the circuit 417. The circuit 417 performs a caliculation in accordance with the following equation (25), using $V_{10}$, $\beta_1$ and $(S_1+y_o)$.

$$v_{P1yo}=\sqrt{V_{10}^2-2\beta_1(S_1+y_o)} \quad (25)$$

The circuit 417 iysues $V_{MO}$ as the signal $v_{P1yo}$, when the output from the adder 416 is $y_o$, i.e. when Si equals to zero.

The adder 426 addes the signal $S_2$ to $y_o$ and delivers the output $(S_2+y_o)$ to the circuit 427. The circuit 427 performs the following calculation using $V_{20}$, $\beta_2$ and $(S_2+y_o)$.

$$v_{p2yo}=\sqrt{V_{20}^2-2\beta_2(S_2+y_o)} \quad (26)$$

The circuit 427 produces a signal of zero level as the output $v_{P2yo}$, when the output from the adder 426 is $y_o$, i.e. when the $S_2$ is zero.

The adder 436 addes the signal $S_3$ to $y_o$ and delivers an output $(S_3+y_o)$ to the circuit 437. The circuit 437 performs the following calculation using $V_{30}$, $\beta_2$ and $(S_3+y_o)$.

$$v_{p3yo}=\sqrt{V_{30}^2-2\beta_2(S_3+y_o)} \quad (27)$$

The circuit 437 produces a signal $V_{MO}$ as the output $v_{P3yo}$, when the output from the adder 436 is yo, i.e. when $S_3$ is zero.

Thus, the pattern velocities $v_{p1yo}$, $v_{p2yo}$ and $v_{p3yo}$ $y_o$ ahead of the instant point are obtained.

Then, the decision circuit 451 makes a calculation in accordance with the following equation (28).

$$V_{PSEL}=\min\{\max(v_{p1yo},v_{p2yo}),\ v_{p3yo}\} \quad (28)$$

The decision circuit 451 then makes a decision as to whether the conditions expressed by the following equations (29), (30) and (31) are satisfied.

$$V_{PSEL}=v_{p1yo} \quad (29)$$

$$V_{PSEL}=v_{p2yo} \quad (30)$$

$$V_{PSEL}=v_{p3yo} \quad (31)$$

The decision circuit 451 then delivers to the selection circuit 452 a signal SEL which represents that the $v_{P1}, v_{P2}$ or $v_{P3}$ should be selected when the equation (29), (30) or (31) are satisfied. Then, in accordance with the signal SEL, the selection circuit 452 selects one out of the velocities $v_{P1}, v_{P2}$ and $v_{P3}$ as the velocity $v_P$ which is then delivered to the velocity command calculator 470 to be processed in the same manner as in the first embodiment described in connection with FIG. 5, so as to be used in the control of the train velocity. The distance $y_o$ is selected to be, for example, 0.5 m.

According to this embodiment, the control is switched to the second or third velocity pattern at a point predetermined distance short of the point at which the second velocity pattern or the third velocity pattern comes to take higher or lower level than the first velocity pattern.

(4) Fourth embodiment

FIG. 8 shows a fourth embodiment of the invention in which the switching to the second or third velocity pattern is made at an instant at which the control command for tracking the first velocity pattern comes to take the same level as the control command for tracking the second or third velocity pattern. By so doing, it is possible to eliminate the step or discontinuity of the control command at the moment of the switching. By so doing, the comfortableness is further improved as compared with the second and the third embodiments.

The point of difference between the fourth embodiment and the first embodiment explained in connection with FIG. 5 resides in the following. Namely, the combination of the selector 450 and velocity control command calculator 470 of the arithmetic unit 400 of FIG. 5 is substituted by the combination of velocity control command calculators 471,472,473 and a selector 455.

The velocity control command calculators 471,472 and 473 are adapted to make calculations in accordance with the following equations (32), (33) and (34), respectively, using velocities $v_{P1}$, $v_{P2}$ and $v_{P3}$, as well as $v_T$, and delivers their outputs $C_{S1}, C_{S2}$ and $C_{S3}$ to the selector 455.

$$C_{S1}=(v_{P1}-v_T)G_1-B_1 \quad (32)$$

$$C_{S2}=(v_{P2}-v_T)G_2-B_2 \quad (33)$$

$$C_{S3}=(v_{p3}-v_T)G_3-B_3 \quad (34)$$

In these equations, symbols $G_1, G_2$ and $G_3$ represent, respectively, the gain constants, whereas symbols $B_1, B_2$ and $B_3$ represent the brake constants. The constants $G_1, G_2, G_3, B_1, B_2, B_3$ can be set through the signal lines 531,532,533.

The selector 455 performs a calculation in accordance with the following equation (35) or (36).

$$C_S=\min\{\max(C_{S1}, C_{S2}), C_{S3}\} \quad (35)$$

$$C_S=\max\{\min(C_{S1}, C_{S2}), C_{S2}\} \quad (36)$$

The calculated $C_S$ is delivered to the lower level selector 60. Then, the lower level selector 60 and the train velocity control device 70 cooperate with each other in processing the signal in the same manner as the first embodiment shown in FIG. 5.

Thus, according to the fourth embodiment of the invention, the control is switched from the first velocity pattern to the second or third velocity pattern at a moment when the control command $C_{S1}$ for tracking the first velocity pattern comes to take the same level as the control command $C_{S2}$ or $C_{S3}$ for tracking the second or the third velocity pattern.

Figure 1:
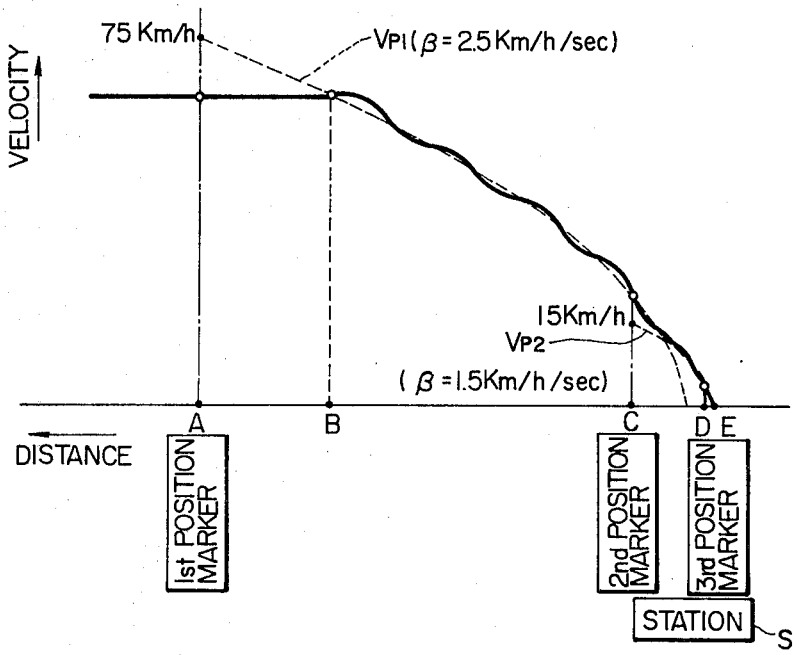
FIG. 1 PRIOR ART
FIG. 1 is a distance-velocity pattern diagram showing an example of a train stopping control method for a train coming into a station using a conventional ATO device.
Figure 2:
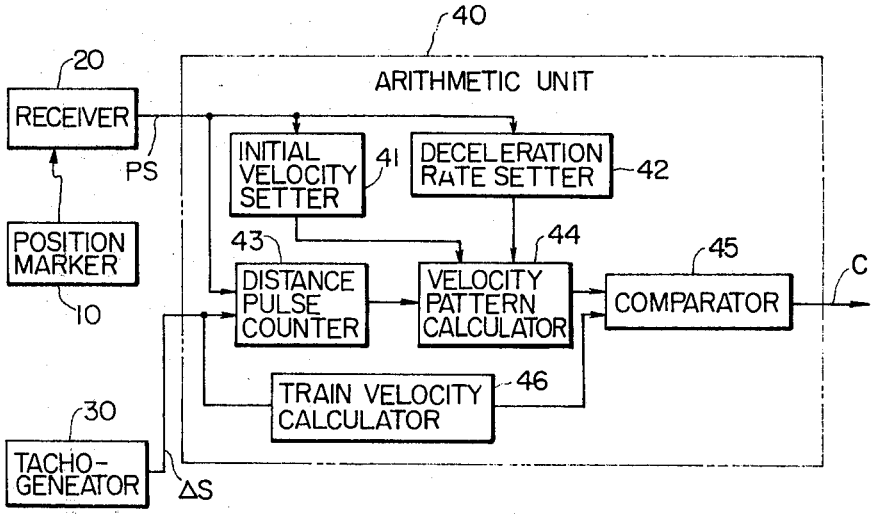
FIG. 2 PRIOR ART
FIG. 2 is an illustration of a train stopping control unit of a conventional ATO device.
Figure 3:
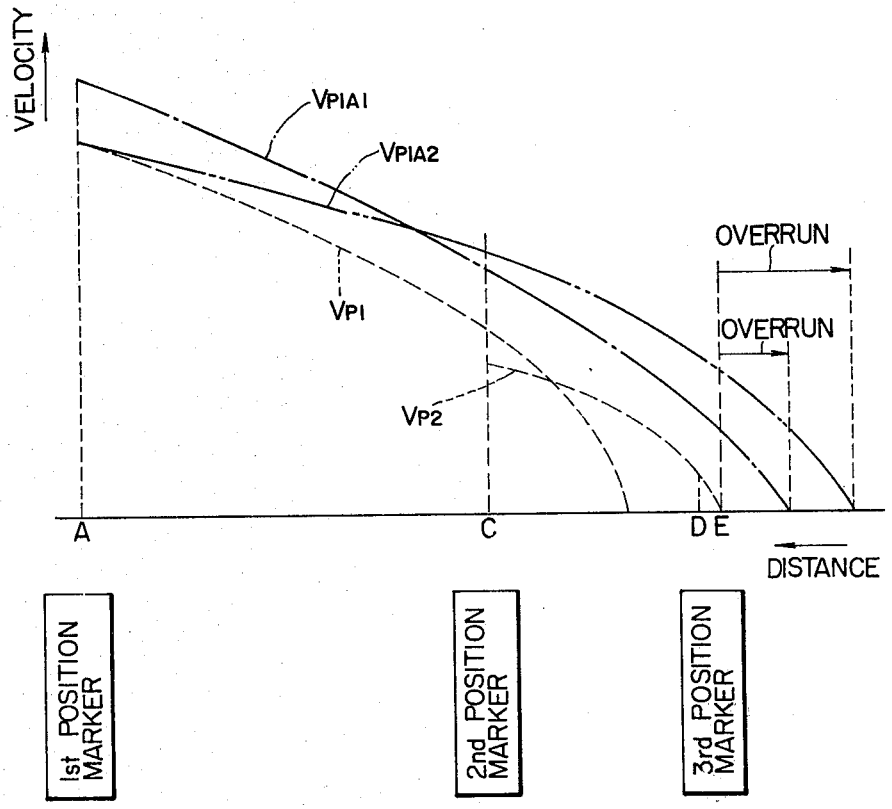
FIG. 3 PRIOR ART
FIG. 3 is a distance-velocity pattern diagram for explaining the reason of over-running which takes place in the use of the conventional ATO device.
Figure 9:
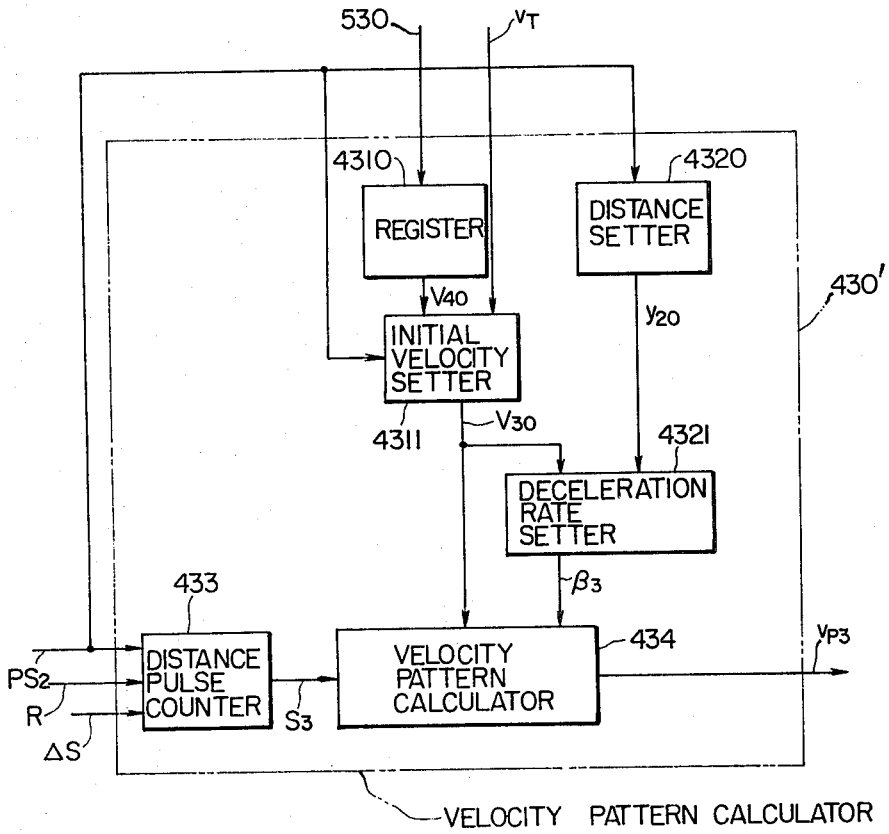
FIG. 9 is an illustration of another example of a velocity pattern generator used in the first to third embodiments of the invention.

FIG. 9 shows a modification of the velocity pattern calculator as used in the first, second and fourth embodiments which have been described in connection with FIGS. 1,2 and 4, respectively. This modification is characterized in that the initial velocity $V_{30}$ and the deceleration $\beta_3$ of the third velocity pattern can be determined on the basis of the actual train velocity $v_{T2}$ at the second point. Namely, the setters 421,422 of velocity pattern calculator 430 of FIG. 5 are substituted by a register 4310, initial velocity setter 4311, distance setter 4320, and deceleration rate setter 4321 to form an arithmetic unit 430'.

A predetermined velocity $V_{40}$ is set in the register 4310 by means of an input device through a signal line 530. The velocity $V_{40}$ is for effecting a so-called elevation of the velocity $v_{T2}$. The initial velocity setter 4311 holds the velocity $v_{T2}$ in accordance with the signal SP2, sampling the velocity $v_T$ and adds the predetermined velocity $v_{40}$ to this velocity $v_{T2}$, and the result of this addition is delivered as the initial velocity set value $V_{30}$.

The distance setter 4320 sets the distance $y_{20}$ between the second point and the target point, in accordance with the signal PS2. The deceleration rate setter 4321 makes a calculation to determine the value of deceleration rate $\beta_3$ in accordance with the following equation (37), using the signal $V_{30}$ and $y_{20}$.

$$\beta_3 = \frac{V_{30}^2}{2y_{20}} \quad (37)$$

The velocity pattern calculator 434 makes a calculation in the same manner as the first embodiment described in connection with FIG. 5, using the thus obtained $V_{30}$ and $\beta_3$, as well as the output $S_3$ from the distance pulse counter 433. According to this arrangement, it is possible to produce a velocity pattern $V_{P3}$ in accordance with the actual train velocity at the second point.

In the modification shown in FIG. 9, the initial velocity $V_{30}$ is set in accordance with the actual train velocity $v_{T2}$ at the second point, and the deceleration rate $\beta_3$ is determined on the basis of the thus set initial velocity $V_{30}$. This, however, is not exclusive, and the initial velocity $V_{30}$ may be determined on the basis of the velocity $v_{P12}$ of the velocity pattern $V_{P1}$ at the second point. Also, not only the deceleration rate $\beta_3$, but also the deceleration rate $\beta_2$ of the second velocity pattern $V_{P2}$ may be determined on the basis of the actual train velocity $v_{T2}$ or velocity $v_{P12}$ of the velocity pattern $V_{P1}$ at the second point.

Preferred embodiments heretofore described have arithmetic units constituted by hardwares. It is, however, to possible to constitute the arithmetic units with computers, e.g. microcomputers. In the latter case, it is necessary to program the arithmetic operation realized by the hardwares. This, however, is quite obvious to those skilled in the art.

From the foregoing description, it will be understood that the train can be stopped precisely at the target point even when the first velocity pattern is generated erroneously or in a wrong way.

What is claimed is:

1. An improved method for controlling the deceleration and point of stopping of a vehicle, the method having the steps of:

producing a first deceleration pattern for the vehicle when the vehicle passes a first point which is located at a first predetermined distance before a target point, said first deceleration pattern having a deceleration characteristic which reduces the velocity of the vehicle to zero at a second point which is normally located between said first and target points;

producing a second deceleration pattern for the vehicle when the vehicle passes a third point which is located at a second distance before said target point, said second deceleration pattern having a deceleration characteristic which has a slower deceleration rate than said first deceleration pattern and which reduces the velocity of the vehicle to zero at said target point;

controlling the velocity of the vehicle to conform to one of said first and second deceleration patterns having a higher corresponding velocity level after the vehicle has passed said third point;

the improvement comprising the further steps of:

providing a third deceleration pattern for the vehicle when the vehicle passes said third point between said first and target points, said third deceleration pattern having a deceleration characteristic which has a greater deceleration rate than said first deceleration pattern and which reduces the velocity of the vehicle to zero at said target point; and controlling the velocity of the vehicle to conform to one of said first and third deceleration patterns having a lower corresponding velocity if said first deceleration pattern keeps a higher corresponding velocity than said second deceleration pattern after the vehicle has passed said third point.

2. The method of claim 1 wherein said third deceleration pattern is produced in response to a marker signal received when the vehicle passes said third point.

3. The method of claim 1 or 2 wherein the velocity controlling of the vehicle is switched to conform to said third deceleration pattern when the velocity level of said third deceleration pattern is detected to become lower than the corresponding velocity level of said first deceleration pattern.

4. The method of claim 1 or 2 wherein the velocity controlling of the vehicle is switched to conform to said third deceleration pattern when the velocity level of said third deceleration pattern is detected to close within a predetermined difference to the corresponding velocity level of said first deceleration pattern.

5. The method of claim 1 or 2 wherein an erroneous first deceleration pattern is produced, the velocity control of the vehicle being conformed to said third deceleration pattern when the vehicle passes a point which is located at a predetermined distance before a fourth point where the velocity level of said third deceleration pattern becomes lower than said erroneous first deceleration pattern.

6. The method of claim 1 or 2 further comprising the step of:

controlling the velocity of the vehicle to conform to a selectable one of the second and third deceleration patterns, each such pattern having associated therewith a corresponding one of second and third control command signals, when a first control command signal, for controlling the velocity of the vehicle to conform to said first deceleration pattern, is equal in value to the one of the second and third control command signals associated with a selected one of the second and third deceleration patterns.

7. The method of claim 2 comprising the further steps of:

receiving a first signal and said marker signal from respective first and second markers, said markers being located at said first and third points, respectively, said first and marker signals being received by a receiver on said vehicle, said receiver producing first and second position signals, PS1 and PS2, respectively;

determining first, second and third initial velocities; $V_{10}$, $V_{20}$ and $V_{30}$; respectively, and first, second and third deceleration rates; $\beta_1$, $\beta_2$ and $\beta_3$; respectively, said initial velocities and deceleration rates being responsive to said PS1 and PS2;

producing distance pulses each of which corresponds to a unit distance, S, traveled by said vehicle during a predetermined interval of time;

counting said distance pulses in response to said first and second position signals, PS1 and PS2, for determining a first distance, $S_1$, between said vehicle and said first point, and a second distance, $S_2$, between said vehicle and said fourth point;

calculating first, second and third pattern velocities; $V_{P1}$, $V_{P2}$ and $V_{P3}$; corresponding to said first, second and third deceleration patterns, respectively, in accordance with the following equations:

$$V_{P1} = \sqrt{V_{10}^2 - 2\beta_1 S_1}$$

$$V_{P2} = \sqrt{V_{20}^2 - 2\beta_2 S_2}$$

$$V_{P3} = \sqrt{V_{30}^2 - 2\beta_3 S_3}$$

calculating the velocity of the vehicle, $V_T$, in response to said distance pulses;

determining the value of first, second and third control command signals; $C_{s1}$, $C_{s2}$ and $C_{s3}$ from said pattern velocities $V_{P1}$, $V_{P2}$ and $V_{P3}$; first, second and third predetermined gain constants, $G_1$, $G_2$ and $G_3$, respectively; and first, second and third predetermined brake constants $B_1$, $B_2$ and $B_3$, respectively, in accordance with the following equations:

$$C_{s1} = (V_{P1} - V_T)G_1 - B_1$$

$$C_{s2} = (V_{P2} - V_T)G_2 - B_2$$

$$C_{s3} = (V_{P3} - V_T)G_3 - B_3$$

determining a control command, $C_s$, in accordance with a selectable one of the following equations:

$$C_s = \min\{\max(C_{s1}, C_{s2}), C_{s3}\} \text{ and}$$

$$C_s = \max\{\min(C_{s1}, C_{s2}), C_{s3}\}, \text{ and}$$

controlling the velocity of the vehicle in response to said control command signal.

8. The method of claim 1 wherein said third deceleration pattern has an initial velocity which is equal to the sum of a velocity of the vehicle at said third point and a predetermined velocity value, and having a deceleration characteristic which has a constant deceleration rate and which reduces the velocity of the vehicle to zero at said target point.

9. The method of claim 1 wherein said third deceleration pattern has an initial velocity which is equal to the sum of a velocity level of said first deceleration pattern at said third point and a predetermined velocity value, and having a deceleration characteristic which has a constant deceleration rate and which reduces the velocity of the vehicle to zero at said target point.

10. An improved method for controlling the deceleration and point of stopping of a vehicle, the method having the steps of:

producing a first deceleration pattern for the vehicle, having a deceleration characteristic which reduces the velocity of the vehicle to zero at a second point which is located at a first predetermined distance from a first point, producing a second deceleration pattern for the vehicle, having a deceleration characteristic which has a slower deceleration rate than the first deceleration pattern and which reduces the velocity of the vehicle to zero at a target point which is located at a second predetermined distance from the first point, controlling the velocity of the vehicle to conform to the one of the first and second deceleration patterns having a higher corresponding velocity level, the improvement comprising the further steps of:

producing a third deceleration pattern for the vehicle, having a deceleration characteristic which has a greater deceleration rate than the first deceleration pattern and which reduces the velocity of the vehicle to zero at the target point, the second and said third deceleration patterns being produced in response to a marker signal received when the vehicle passes a third point which is located at a third predetermined distance being shorter than the first and second predetermined distances; and controlling the velocity of the vehicle to conform to a selectable one of the second and said third deceleration patterns when a selected one of the second and said third deceleration patterns differs in velocity level from the corresponding velocity level of the first deceleration pattern by an associated predetermined velocity value, the velocity of the vehicle being controlled to said third deceleration pattern when the vehicle has passed a fourth point which is located at a fourth predetermined distance from the first point.

11. The method of claim 10 further comprising the step of controlling the velocity of the vehicle to conform to said third deceleration pattern beginning at a fifth point which is located at a predetermined distance before a fourth point, with respect to the direction of travel of the vehicle, said fourth point being located where said third deceleration pattern corresponds to a velocity level which is lower than the first deceleration pattern.

12. The method of claim 10 further comprising the step of controlling the velocity of the vehicle to conform to a selectable one of the second and said third deceleration patterns, each such pattern having associated therewith a corresponding one of second and third control command signals, when a first control command signal, for controlling the velocity of the vehicle to conform to the first deceleration pattern, is equal in value to the one of said second and third control command signals associated with a selected one of the second said deceleration patterns.

* * * * *